US006533671B2

(12) United States Patent
Isabelle et al.

(10) Patent No.: US 6,533,671 B2
(45) Date of Patent: Mar. 18, 2003

(54) COMPOSITE LANDING SURFACE FOR SPORTS

(75) Inventors: Edward Isabelle, Woodward, PA (US); Frank L. Bare, Salt Lake City, UT (US)

(73) Assignee: Woodward Camp Properties, Inc., Woodward, PA (US)

( * ) Notice: Subject to any disclaimer, the term of this patent is extended or adjusted under 35 U.S.C. 154(b) by 0 days.

(21) Appl. No.: 09/870,964

(22) Filed: May 31, 2001

(65) Prior Publication Data

US 2002/0183124 A1 Dec. 5, 2002

(51) Int. Cl.[7] ..... A63C 19/10
(52) U.S. Cl. ..... 472/89; 472/90; 14/69.5
(58) Field of Search ..... 472/88, 89, 90, 472/92, 94; 404/17, 32, 33, 44; 14/69.5

(56) References Cited

U.S. PATENT DOCUMENTS 3,859,768 A * 1/1975 Donzis ..... 472/92
3,908,556 A * 9/1975 Stuhmer ..... 104/134
4,068,840 A * 1/1978 Spaulding, Jr. ..... 472/92
4,129,916 A * 12/1978 Schlesinger et al. ..... 14/69.5
4,819,932 A * 4/1989 Trotter, Jr. ..... 472/92
5,085,424 A * 2/1992 Wood, Jr. ..... 106/638
5,524,310 A * 6/1996 Farnen ..... 14/69.5
5,605,721 A * 2/1997 Di Geronimo ..... 156/330.9
5,749,787 A * 5/1998 Jank ..... 404/32

* cited by examiner

*Primary Examiner*—Kien T. Nguyen
(74) *Attorney, Agent, or Firm*—Dann, Dorfman, Herrell and Skillman, P.C.

(57) ABSTRACT

An apparatus having a composite landing surface for sports equipment, such as bicycles, motorcycles, skateboards, in-line skates, skis and snowboards, is provided. The invention includes a base member or structure, a shock absorbing layer, and a rigid material on top of the shock absorbing layer. The shock absorbing layer absorbs impact forces generated when sports equipment lands on the landing surface. The rigid layer provides a stiff top surface that distributes loads and limits surface deflection during a landing. When an athlete performs an aerial maneuver using sports equipment and lands on the composite surface, the athlete experiences a cushioned landing but is able to roll or slide on the landing surface after the landing.

25 Claims, 4 Drawing Sheets

COMPOSITE LANDING SURFACE FOR SPORTS

FIELD OF THE INVENTION

The present invention relates to composite surfaces and structures for use with sports equipment, such as freestyle bicycles, motorcycles, skateboards, snowboards, skis, in-line skates and the like. More specifically, the present invention relates to multi-layered structures that cushion the landing impact of sports equipment after aerial maneuvers while providing a firm enough surface to allow the equipment to roll or slide after landing.

BACKGROUND OF THE INVENTION

The class of sports known as "extreme sports" has become a popular form of activity for many athletes. Freestyle bicycling, skateboarding and in-line skating (or rollerblading) in particular have evolved into immensely popular extreme sports. Motocross racing and freestyle ski jumping have also been popular sports. In these sports, athletes test their skill and creativity by performing aerial maneuvers and related stunts. Stunts are performed on various apparatuses, including jumps, ramps (sometimes called "vert ramps") and other apparatuses having different geometries. Box jumps include inclined surfaces that project the athlete upwardly and forwardly into the air, where the athlete can execute a variety of aerial maneuvers. Vert ramps are U-shaped structures that allow athletes to ride up and down curved surfaces and perform maneuvers while being projected vertically from the side walls.

When aerial maneuvers are performed using bicycles, motorcycles, skateboards, snowboards, skis, in-line skates, and the like, it is essential that the equipment rolls or slides on the landing surface after landing. If the equipment abruptly stops on the landing surface, the athlete's momentum will cause him to jerk forward or fly off the equipment upon landing. The ability to roll or slide upon landing also enables athletes to perform stunts in succession. That is, an athlete is able to execute an aerial maneuver, land on an apparatus, and accelerate into another aerial maneuver or stunt. Frequently, the athlete will increase speed after each stunt to build momentum and perform more difficult maneuvers. As a result, it is desirable for the athlete to be able to roll or slide on the landing surface after a landing.

Extreme sports carry a significant risk of injury. In freestyle bicycling, for example, an athlete can be propelled six or more feet in the air before landing on an apparatus. In addition to leaving the ground, some bicyclists rotate their orientation in mid-air, or temporarily leave their seat and remount the bicycle prior to landing. In freestyle ski jumping, the athlete skis up a ramp and is propelled vertically in the air where he can perform a series of body rotations and flips prior to landing. Injuries from a hard landing or an improper landing can range from minor injuries, such as bruises or abrasions, to much more serious injuries, including broken bones, dislocations or paralysis. To reduce the risk of injury, extreme sports athletes typically wear helmets and pads for their knees, elbows and wrists. However, protective gear only offers limited protection and does not significantly lower the risk of injury from high impact landings. Landing surfaces on ramps, jumps and pits are typically constructed with materials such as wood or concrete. Landing areas for ski and snowboard jumps are often densely packed snow. These surfaces are not designed to absorb impact forces generated during a hard landing, subjecting athletes to significant risk of injury.

Commercially available mats, such as gymnastics mats, can absorb impact forces but are generally not suitable for the sports described above, In particular, gymnastics mats do not distribute weight over a large surface area. This creates a major problem for athletes on wheeled sports equipment, skis or snowboards. When the athlete completes an aerial maneuver and lands on the gymnastics mat, the equipment will land with an abrupt halt and sink into the mat. The athlete's momentum will cause him to fall forward and/or be thrown off the equipment. As a result, harder and less forgiving surfaces that allow rolling and sliding after landings must be used in these sports.

In light of the dangers presented by hard landing surfaces, the practice of aerial maneuvers is difficult. To develop skills, athletes must attempt stunts numerous times, experiment with new maneuvers and gradually increase the degree of difficulty of their stunts. Repeated falls and landings on hard surfaces can result in injury. Moreover, the risks of injury from hard surfaces can undermine an athlete's confidence and limit his ability to learn maneuvers that have higher degrees of difficulty. As a result, there is a need for an improved landing surface that allows for safer utilization of wheeled sports equipment, skis, snowboards and the like, particularly in the practice of aerial maneuvers.

SUMMARY OF THE INVENTION

With the foregoing in mind, the present invention provides a safer landing surface for athletes who use wheeled sports equipment, skis, snowboards and the like in performing aerial maneuvers. The invention includes a multi-layered landing surface containing a base member, a shock absorbing layer, and a firm surface layer on top of the shock absorbing layer. The shock absorbing layer absorbs impact forces generated from hard landings. The firm surface layer provides a stiffer landing surface that distributes loads and limits surface deflection during a landing.

The landing surface includes a contoured frame and platform structure that forms the base of the apparatus. A shock absorbing layer, formed of resilient material such as a synthetic resin or foam material, is disposed on top of the base. The shock absorbing layer has a specific stiffness and thickness range suitable for absorbing a substantial amount of the impact from a landing, while stiff enough to limit deflection of the top layer material. The firm surface layer is a high molecular weight material that is firm enough to distribute loads without cracking, buckling or significantly deflecting. The combined materials form a landing surface that absorbs a substantial amount of impact force while being stiff enough to allow an individual to roll or slide after landing on the surface.

DESCRIPTION OF THE DRAWINGS

The foregoing summary as well as the following detailed description of the preferred embodiments will be best understood when read in conjunction with the following drawings, in which.

DESCRIPTION OF THE PREFERRED EMBODIMENT

Figure 1:
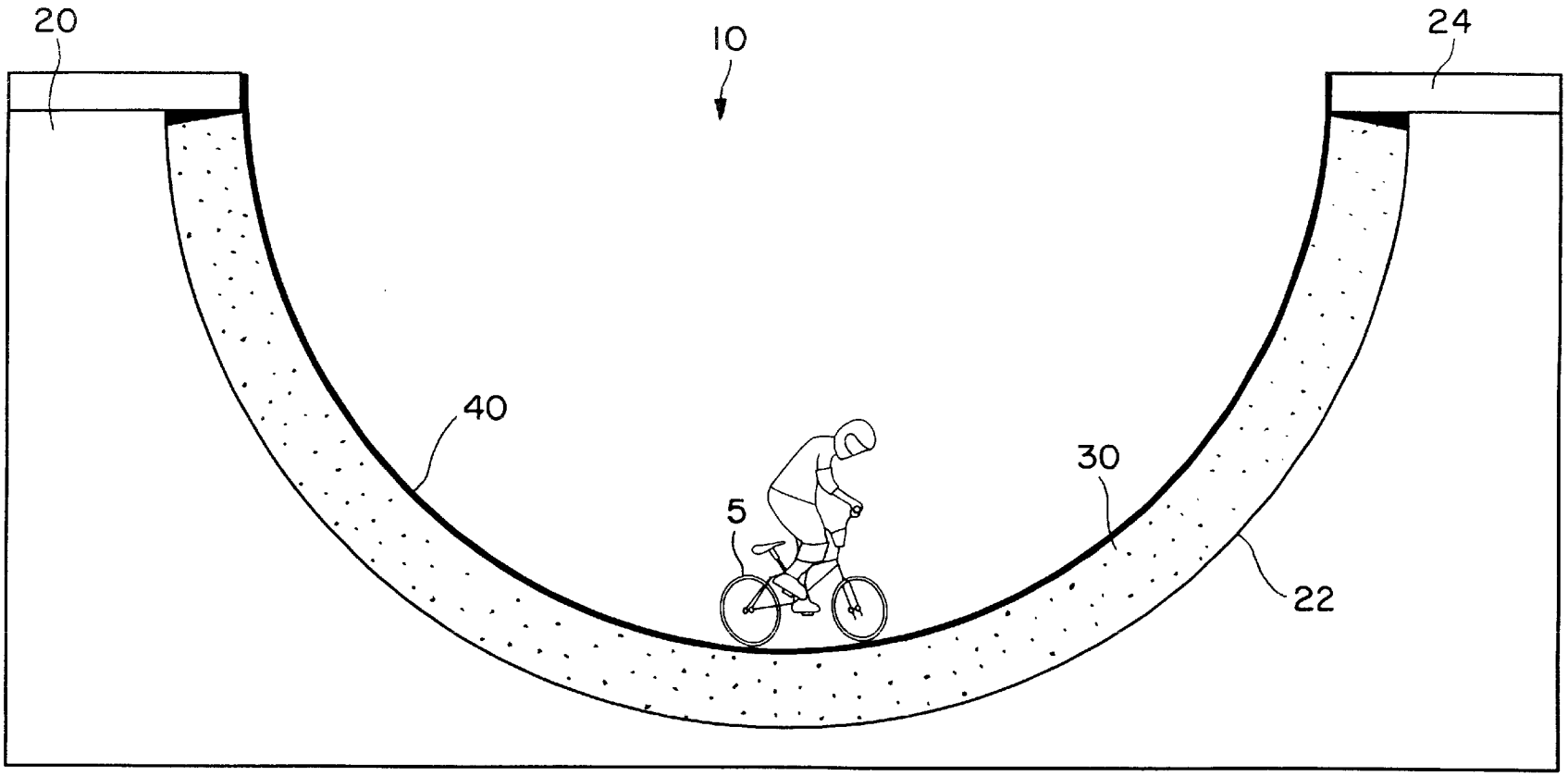
FIG. 1 is a cross-sectional view of a composite surface used in a vert ramp apparatus.

Referring now to FIGS. 1–4 in general and FIG. 1 specifically, an athlete is shown using wheeled sports equipment on a composite surface 10. In particular, the athlete is shown riding a freestyle bicycle 5 on composite surface 10 in a vert ramp structure. The composite surface 10 includes a base structure 20 with a generally parabolic top surface. A shock absorbing layer 30 is disposed on top of base structure 20. The shock absorbing layer 30 supports a stiff top layer 40 and conforms with the generally parabolic top surface of base structure 20. The multi-layered surface 10 provides a firm cushion-like landing surface suitable for the bicycle 5.

Referring to FIG. 1, base structure 20 is formed using a post and beam construction with top and side panels, or comparable method of construction. Preferably, base 20 is constructed of lumber, such as plywood. The base structure 20 has a pair of opposing top decks 24 and a top surface or face 22 having a generally U-shaped cross-section. In particular, the cross-section of top face 22 defines an inverted arc or a combination of arcs extending tangentially and outwardly from a horizontal section. A shock absorbing layer 30 is placed on the top surface 22 of base 20. The bottom surface of shock absorbing layer 30 frictionally engages top surface 22 of base 20 so that the shock absorbing layer resists sliding on the base.

The shock absorbing layer 30 can be formed using a number of soft resilient materials, such as a medium containing gel, air, or foam material. In FIG. 1, the composite surface 10 is shown with a shock absorbing layer 30 formed of an open cell polyurethane foam material.

Variables may be adjusted in the design of the shock absorbing layer 30 to selectively adjust the overall firmness of the landing surface. Where foam is chosen, as shown in FIG. 1, the foam material is commercially available in a wide range of densities and thicknesses. Density and thickness of foam layer 30 is dependent on the geometry of the apparatus and the type of equipment being used on the apparatus. For example, in motocross racing, motorcycles are projected as high as 30 feet in the air before landing. Jumps of this magnitude generate impact forces much greater than the impact forces created when skateboards or other lighter equipment land after aerial maneuvers. As a result, foam density and thickness selected for motorcycle landings will differ significantly from foam density and thickness selected for smaller and lighter equipment.

FIG. 1 illustrates a vert ramp apparatus suitable for freestyle bicycles, skateboards and in-line skates. In this type of application, the density of foam layer 30 is preferably between 1.0 to 1.2 pounds per cubic foot and more preferably 1.1 pounds per cubic foot. The indentation load deflection, or ILD, of the foam layer 30 is preferably 19 pounds. The total thickness of the foam layer 30 is preferably between 14 inches and 24 inches. Foam layer 30 can be constructed using any commercially available foam product, such as polyurethane foam manufactured by Penn Foam Corporation, Allentown, Pa. (part no. 1119).

Foam layer 30 is installed in a single layer on the top surface 22 of base 20. Alternatively, foam layer 30 may be installed in smaller sections that are easier to handle during construction. For example, the foam layer 30 may be installed in two lifts or layers, each lift having one half of the thickness of foam layer 30. In a two lift installation, the first lift of foam is installed on the top surface 22 of base 20. The second layer is then installed on top of the first layer. Foam lifts may also be divided and installed in separate sections to simplify handling and assembly. When foam layer 30 is assembled in multiple lifts or sections, the pieces of foam are preferably bonded together to form an integrated foam layer. Preferably, the foam pieces are bonded using an acrylic resin and synthetic rubber spray adhesive or other adhesive suitable for joining foam materials, such as SIMALFA waterborne adhesives, manufactured by Alfa Adhesives, Inc., North Haledon, N.J.

Once in place, the edges of foam layer 30 extend upwardly, terminating beneath top decks 24, as shown in FIG. 1. A smooth rigid top layer 40 covers the top surface of foam layer 30. The ends of rigid top layer 40 are preferably fixed to top decks 24 using flush mounted screws, adhesives or other suitable fasteners that will not disrupt the smooth surface of top layer 40. Top layer 40 is installed in sections as required to cover the top surface of foam layer 30. Preferably, top layer 40 includes continuous sheets with no seams running transverse to the U-shaped cross-section of the apparatus. The top layer 40 is preferably formed of one or more semi-rigid ¼ inch thick high molecular weight polyethylene sheets, such as polyethylene sheeting manufactured by U.S. Liner of Ambridge, Pa. (part number EZ10S50A).

While FIG. 1 shows an athlete using a freestyle bicycle 5, the composite surface 10 is also intended to be used with sports equipment having smaller wheels, such as skateboards and in-line skates. The outside diameter of wheels used on in-line skates is typically in the range of 62 to 70 mm, as opposed to freestyle bicycle wheels, which typically have an outside diameter of 50.8 cm. The polyethylene sheets of top layer 40 are rigid enough to resist significant deflection when sports equipment lands on the surface. Since the top layer 40 resists deflection, it allows smaller wheels, like those on skateboards and in-line skates, to roll after landing on the surface 10.

Referring again to FIG. 1, the composite surface works as follows. Starting from either the top decks 24 or from the bottom of the vert ramp structure, an athlete rides up and down the sides of the vert ramp until he generates enough velocity to propel himself vertically above the side walls and perform an aerial maneuver. After completing the maneuver, the athlete lands on the composite surface. In some instances, the athlete will land along the steep side portion of the ramp and continue rolling down the side of the ramp. In this inclined position, the component of force directed into the composite surface will be minimal, since the majority of force will be directed downwardly in the direction of gravity. In other instances, the athlete will not land properly, landing more toward the center of the vert ramp where the composite surface is closer to horizontal. In such cases, a significant portion of the impact force is directed into the composite surface. This force is first transferred to the top layer 40. Since top layer 40 is formed of a semi-rigid high molecular weight material, the top layer substantially resists deflection under the load, and the magnitude of the load is distributed over a larger area within the top layer. The distributed load carried by top layer 40 is then transferred to shock absorbing layer 30. The shock absorbing layer 30 has a low ILD and consequently has a relatively low resistance to compression when subjected to the distributed load. As a result, the shock absorbing layer 30 deflects, absorbing some of the distributed load. Since the distributed load is partially absorbed by shock absorbing layer 30, the reaction force exerted back to the athlete is reduced. Therefore, the athlete experiences a cushioned effect when landing on the composite surface.

Thus far, the composite surface has been illustrated in the form of a U-shaped vert ramp apparatus. The invention can be used in a variety of configurations, however, and is not limited to the U-shaped geometry in FIG. 1. In extreme sports, athletes perform maneuvers on courses that provide an assortment of ramps and apparatuses having a variety of slopes and shapes. This allows athletes of all abilities to try maneuvers and develop skills at their own pace. Therefore, the composite surface is intended for use on apparatuses having any geometrical configuration and on which sports equipment land after an aerial maneuver or stunt.

Figure 2:
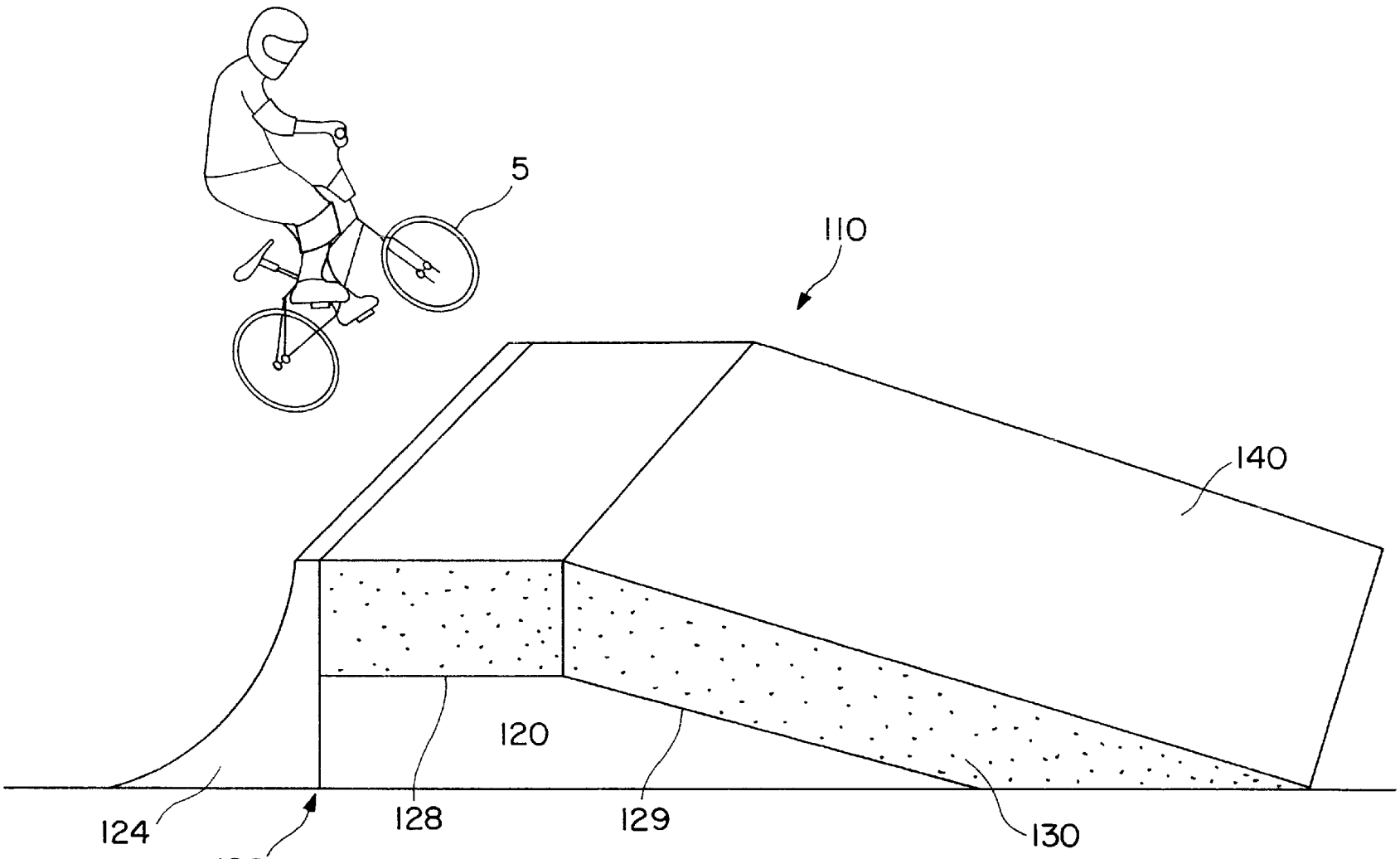
FIG. 2 is an isometric view of a second embodiment of the invention, illustrating a composite surface used in a box jump apparatus.

Now referring to FIG. 2, an athlete is shown using wheeled sports equipment on a second embodiment of the invention. In particular, the athlete is shown riding a freestyle bicycle 5 on a multi-layered apparatus 110 in the form of a box jump structure. The multi-layered apparatus 110 comprises a base 120, a shock absorbing layer 130 and a top layer 140. Base 120 includes a ramp 124 that projects an athlete upwardly and forwardly over apparatus 110. As in the first embodiment, the multi-layered apparatus 110 provides a firm cushion-like landing surface suitable for sports equipment.

Referring to FIG. 2, base structure 120 is formed using a post and beam construction with top and side panels, or comparable method of construction. Preferably, base 120 is constructed of lumber and plywood. The base structure 120 includes a ramp section 124 at its front end and a landing section 126 at its rear end. Ramp section 124 includes a generally parabolic face that is flush with the surrounding grade at its bottom so as to form a smooth upward ramp surface with the surrounding grade level. Landing section 126 includes a generally horizontal section 128 and sloping exit section 129. The exit section 129 descends linearly from the top of flat section 128 to surrounding grade level.

Landing section 126 is disposed adjacent to ramp section 124 and is preferably integral with the ramp section. The height of flat section 128 is less than the height of ramp 124, forming a terrace on the rear side of the ramp. The shock absorbing layer 130 is installed on the terrace, flush against the rear side of ramp 124. The top surface of shock absorbing layer 130 is generally level with the top of ramp section 124. In addition, the top surface of shock absorbing layer 130 is generally congruent with the top surface of landing section 126. More specifically, the top surface of shock absorbing layer 130 is generally horizontal above flat section 128 and descends in a parallel manner with the top surface of exit section 129 until it meets grade level. The bottom surface of shock absorbing layer 130 frictionally engages the rear face of ramp 124 and top surface of landing section 126 so as to resist sliding and shifting on base 120.

As in the first embodiment, the shock absorbing layer 130 can be formed using a number of soft resilient materials, such as a medium containing gel, air, or foam material. In FIG. 1, the composite surface 10 is shown with a shock absorbing layer 30 formed of an open cell polyurethane foam material. The density of the foam layer 130 is preferably between 1.0 to 1.2 pounds per cubic foot and ideally 1.1 pounds per cubic foot. The indentation load deflection, or ILD, of the foam layer 130 is preferably 19 pounds. The total thickness of foam layer 130 is largely dependent on the desired height of ramp 124. Preferably, the thickness of foam layer 130 is between 24 and 36 inches. The foam material is a commercially available polyurethane product, such as foam manufactured by Penn Foam Corporation, Allentown, Pa. (part no. 1119).

Foam layer 130 is installed in a single layer on the top surface of landing section 126. Alternatively, foam layer 130 may be installed in sections or lifts to facilitate easier handling and installation. For instance, foam layer 130 may be installed in two separate sections or blocks corresponding to the change in pitch on landing section 126, as shown in FIG. 2. In FIG. 2, the first block is installed above flat section 128, and the second block is installed above exit section 129. The rear edge of foam layer 130 is extended and cut so as to conform with grade level.

When foam layer 130 is assembled in blocks, the blocks of foam are preferably bonded together to form an integrated foam layer. The bonding agent is preferably an acrylic resin and synthetic rubber spray adhesive or other adhesive suitable for joining foam materials, such as SIMALFA waterborne adhesives, manufactured by Alfa Adhesives, Inc., North Haledon, N.J.

A thin rigid top layer 140 covers the top surface of foam layer 130, similar to the first embodiment. The forward edge of rigid top layer 140 is fixed directly to the top surface of ramp 124 using one of a variety of fasteners, such as flush mounted screws, or glue bonded to the top decks. Preferably, top layer 140 is formed of a continuous sheet that covers the foam layer 130 with no seams. The top layer 140 is preferably formed of ¼ inch thick high molecular weight polyethylene sheets, such as polyethylene sheeting manufactured by U.S. Liner of Ambridge, Pa. (part number EZ10S50A).

Figure 3:
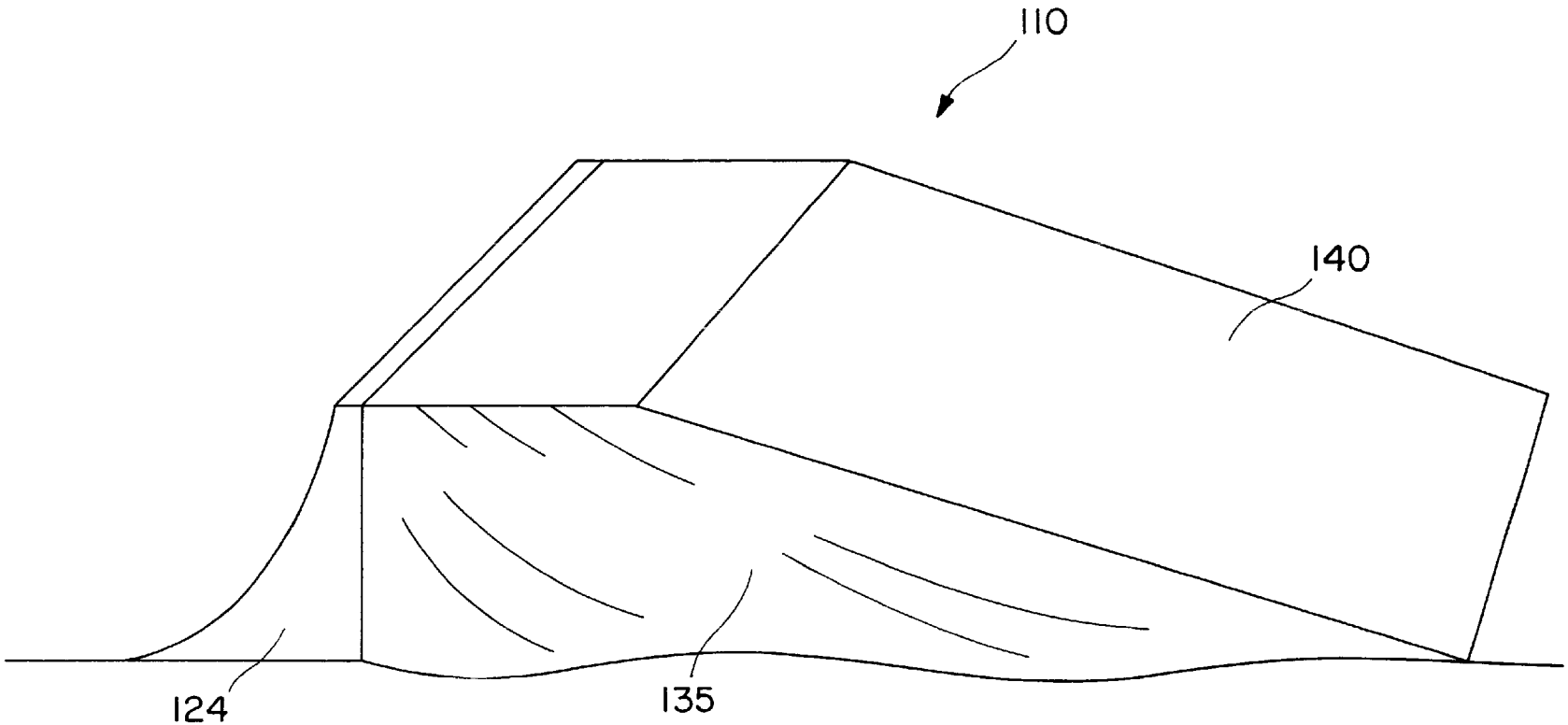
FIG. 3 is an isometric view of the box jump apparatus in FIG. 2, illustrating the apparatus in an outdoor installation.

In outdoor installations, there is a need to prevent water and moisture from contacting and penetrating the foam layer 130. By nature of its porous property, foam is capable of absorbing large amounts of moisture. Water that penetrates the foam layer 130 can change the resilient characteristics of the material and affect the performance of the landing surface. FIG. 3 shows an outdoor box jump apparatus with an impermeable sheath 135. The sheath 135 may be made of vinyl or other impermeable sheet material. The sheath 135 is placed between the top surface of foam layer 130 and the top layer 140 and extends over the sides of the foam layer so as to limit the exposure of the foam layer to sources of moisture, such as precipitation, that may enter from the sides of the apparatus. The rear edge of the sheath 135 is rolled underneath the section of foam that extends beyond the exit section 129 to minimize the amount of moisture that can penetrate the underside of foam layer 130. Alternatively, base 120 may include a flat panel of plywood, plastic, or other material to limit the amount of moisture that contacts the underside of the foam section extending beyond the exit section 129.

Thus far, the shock absorbing layer has been described as being a polyurethane foam material. However, the disclosure of the shock absorbing layer is intended to include different materials that share the same resilient characteristics as polyurethane foam. On certain apparatuses, it may be advantageous to use an alternative to foam, such as a fluid-filled cushion. Polyurethane foam must be protected from moisture on outdoor apparatuses, as discussed earlier. The shock absorption capacity of a fluid-filled cushion is not affected by external moisture, and therefore would be advantageous in an installation exposed to significant moisture.

Figure 4:
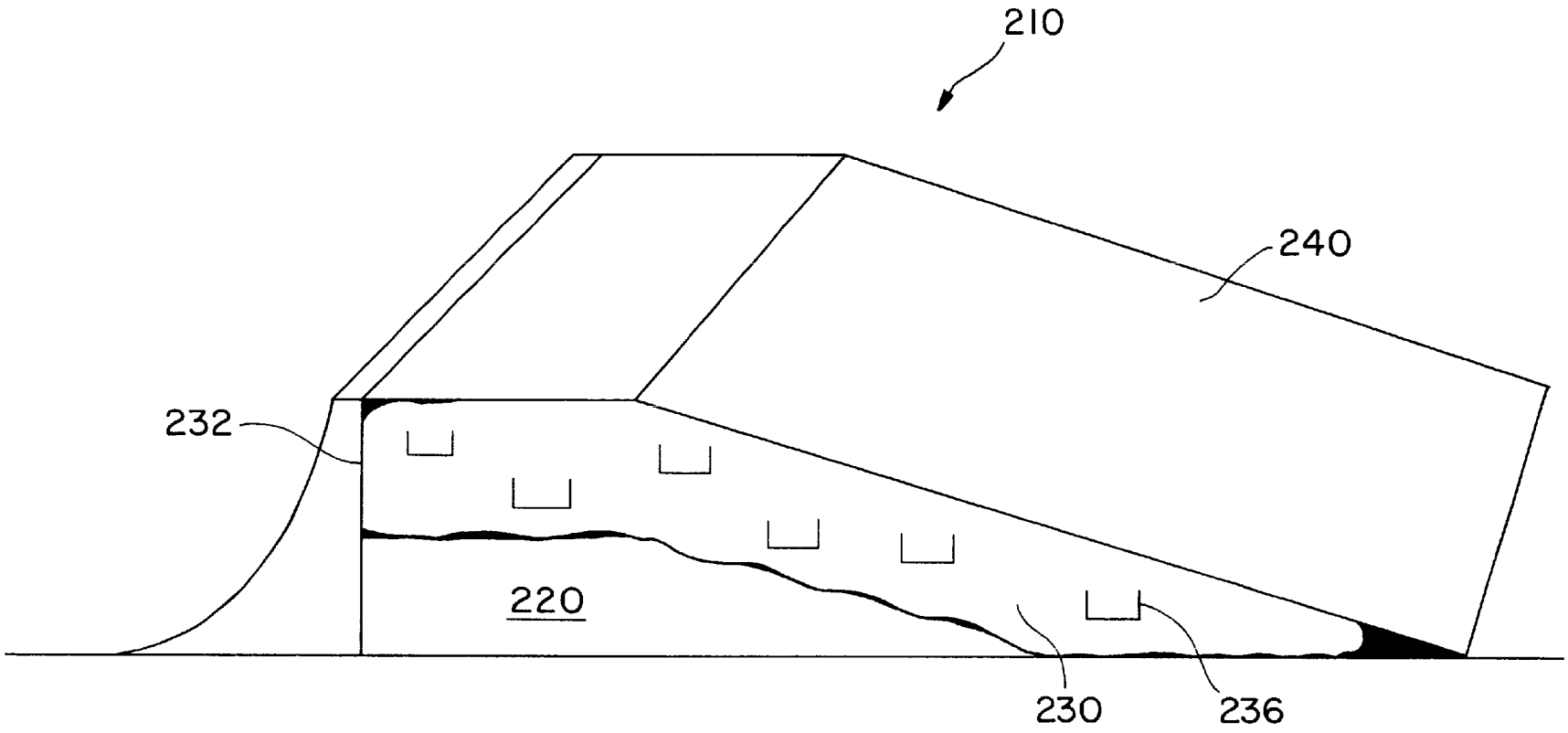
FIG. 4 is an isometric view of a third embodiment of the invention, illustrating a composite surface used in a box jump apparatus.

Referring now to FIG. 4, a third embodiment of the invention is illustrated which employs a fluid-filled cushion. In FIG. 4, a composite surface 210 is shown, which comprises a base 220, a fluid-filled cushion 230 and top layer 240. As in the second embodiment, the multi-layered apparatus 210 provides a firm cushion-like landing surface suitable for sports equipment. The fluid-filled cushion 230 includes a lining 232 made of an durable synthetic material, such high gauge vinyl. The top layer 240 frictionally engages fluid-filled cushion 230. Moreover, fluid-filled cushion 230 frictionally engages base 220 so as to resist sliding on the base.

The cushion 230 is filled with a fluid medium, such as a volume of air or a liquid medium such as water or a gel. In FIG. 4, the cushion 230 is shown filled with compressed air. Preferably, cushion 230 contains a plurality of inner control cords connected to the cushion lining 232. The control cords are adjustable to various tensions to modify the shape and surface contour of cushion 230 so as to conform to base structure 220 and top layer 240. The control cords are also adjustable for tuning the firmness of the cushion 230. In particular, adjustment of the control cords changes the internal cross section of cushion 230 at various points. This controls fluid flow within the cushion and adjusts the firmness of the landing surface 210.

Preferably, the air cushion 230 has a plurality of adjustable vent flaps 236, as shown in FIG. 4. During a landing of wheeled sports equipment, air inside the cushion 230 is compressed beneath the impact area of the landing. This compression displaces some of the air outwardly toward the inside surface of lining 232. Vent flaps 236 allow a portion of the displaced air to escape from inside the cushion 230, deflating the cushion. Deflation of the cushion is controlled by the size of the vent openings and resistance of the vent flaps, which require a minimum compressive force to open the flaps. As a result, the rate of deflation is relatively slow so that a portion of the impact force is gradually dissipated. Since some of the impact force is absorbed and dissipated through the fluid-filled cushion 230, the athlete experiences a softened landing.

The terms and expressions which have been employed are used as terms of description and not of limitation. There is no intention in use of such terms and expressions of excluding any equivalents of the features shown and described or portions thereof. It is recognized, however, that various modifications of the embodiments described herein are possible within the scope and spirit of the invention. Accordingly, the invention incorporates variations that fall within the scope of the following claims.

We claim:

1. An apparatus used in sports having a multi-layered landing structure, including an impact surface on which sports equipment lands with an impact force after an aerial maneuver, comprising:

a base member;

a rigid top layer; and a shock absorbing layer disposed between the base member and rigid top layer, wherein the top layer is comprised of at least one continuous sheet in frictional engagement with the shock absorbing layer, and said impact surface substantially absorbs the impact force of sports equipment that lands on the surface after an aerial maneuver, while substantially resisting deflection during said landing such that the sports equipment can roll or slide after landing on the surface.

2. An apparatus used in sports having a multi-layered landing structure, including an impact surface on which sports equipment lands with an impact force after an aerial maneuver, comprising:

a base member;

a rigid top layer; and a shock absorbing layer disposed between the base member and rigid top layer, wherein the shock absorbing layer is comprised of a fluid-filled cushion, and wherein said impact surface substantially absorbs the impact force of sports equipment that lands on the surface after an aerial maneuver, while substantially resisting deflection during said landing such that the sports equipment can roll or slide after landing on the surface.

3. An apparatus used in sports having a multi-layered landing structure, including an impact surface on which sports equipment lands with an impact force after an aerial maneuver, comprising:

a ramp structure having a raised end; and a multi-layered landing structure, comprising:

a base member;

a rigid top layer; and a shock absorbing layer disposed between the base member and rigid top layer, wherein the top layer is comprised of at least one continuous sheet in frictional engagement with the shock absorbing layer, and said impact surface substantially absorbs the impact force of sports equipment that lands on the surface after an aerial maneuver, while substantially resisting deflection during said landing such that the sports equipment can roll or slide after landing on the surface.

4. An apparatus used in sports having a multi-layered landing structure, including an impact surface on which sports equipment lands with an impact force after an aerial maneuver, comprising:

a ramp structure having a raised end; and a multi-layered landing structure, comprising:

a base member;

a rigid top layer; and a shock absorbing layer disposed between the base member and rigid top layer;

wherein the shock absorbing layer is comprised of a fluid-filled cushion, and wherein said impact surface substantially absorbs the impact force of sports equipment that lands on the surface after an aerial maneuver, while substantially resisting deflection during said landing such that the sports equipment can roll or slide after landing on the surface.

5. An apparatus used in sports having a multi-layered landing structure, including an impact surface on which sports equipment lands with an impact force after an aerial maneuver, comprising:

a base member;

a shock absorbing layer directly contacting the base member in slidable engagement, said slidable engagement between the base member and the shock absorbing layer being characterized by a first coefficient of friction; and a rigid top layer directly contacting the shock absorbing layer in slidable engagement, said slidable engagement between the shock absorbing layer and the rigid top layer being characterized by a second coefficient of friction, wherein the first coefficient of friction is of sufficient magnitude to resist sliding and shifting between the base member and the shock absorbing layer.

6. The apparatus of claim 5, wherein the top layer is comprised of a high molecular weight polyethylene material.

7. The apparatus of claim 5, wherein the top layer is comprised of a continuous sheet.

8. The apparatus of claim 5, wherein the shock absorbing layer has an indentation load deflection of 19 pounds and a density of 1.1 pounds per cubic foot.

9. The apparatus of claim 5, wherein the shock absorbing layer is comprised of a foam body.

10. The apparatus of claim 9, Wherein the foam body is comprised of a plurality of sections of foam fitted together to form a solid body of foam.

11. The apparatus of claim 10, wherein the plurality of sections of foam are bonded together to form an integrated layer of foam.

12. The apparatus of claim 5, wherein the landing structure is generally U-shaped in cross section.

13. The apparatus of claim 5, wherein the landing structure comprises a horizontal platform and a linearly descending ramp adjacent to the platform.

14. The apparatus of claim 5, wherein the shock absorbing layer is comprised of a fluid-filled cushion.

15. The apparatus of claim 5, further comprising an impermeable sheath inserted between the rigid top layer and the shock absorbing layer to substantially cover the shock absorbing layer.

16. An apparatus used in sports having a multi-layered landing structure, including an impact surface on which sports equipment lands with an impact force after an aerial maneuver, comprising:

a base member having a top face;

a rigid top layer having a bottom face; and a homogeneous layer of foam directly contacting substantially all of the top face of the base member and directly contacting substantially all of the bottom face of the rigid top layer.

17. The apparatus of claim 16, wherein the foam layer directly contacts the base member in slidable engagement, said slidable engagement between the base member and the foam layer being characterized by a first coefficient of friction, and wherein the rigid top layer directly contacts the foam layer in slidable engagement, said slidable engagement between the foam layer and the rigid top layer being characterized by a second coefficient of friction.

18. The apparatus of claim 17, wherein the first coefficient of friction is of sufficient magnitude to resist sliding and shifting between the base member and the foam layer.

19. The apparatus of claim 16, wherein the top layer is comprised of a high molecular weight polyethylene material.

20. The apparatus of claim 16, wherein the foam layer has an indentation load deflection of 19 pounds and a density of 1.1 pounds per cubic foot.

21. The apparatus of claim 16, wherein the foam layer is comprised of a plurality of sections of foam fitted together to form a solid body of foam.

22. The apparatus of claim 21, wherein the plurality of sections of foam are bonded together to form an integrated layer of foam.

23. The apparatus of claim 16, wherein the landing structure is generally U-shaped in cross section.

24. The apparatus of claim 16, wherein the landing structure comprises a horizontal platform and a linearly descending ramp adjacent to the platform.

25. The apparatus of claim 16 further comprising an impermeable sheath inserted between the rigid top layer and the foam layer to substantially cover the foam layer.

* * * * *